United States Patent [19]

Long

[11] 4,096,830

[45] Jun. 27, 1978

[54] CONTROL SYSTEM FOR ELECTRICALLY ENERGIZED ENGINE FUEL

[75] Inventor: E. David Long, Elmira, N.Y.

[73] Assignee: Allied Chemical Corporation, Morris Township, N.J.

[21] Appl. No.: 629,349

[22] Filed: Nov. 6, 1975

[51] Int. Cl.[2] ..... F02B 3/00

[52] U.S. Cl. ..... 123/32 EA; 123/179 G

[58] Field of Search ..... 123/32 EA, 179 G, 139 ST, 123/139 E, 139 AN, 139 AW; 417/42, 417

[56] References Cited

U.S. PATENT DOCUMENTS

| | | | |
|---|---|---|---|
| 2,966,902 | 1/1961 | Nallinger | 123/139 AN |
| 3,465,732 | 9/1969 | Kattchee | 123/32 |
| 3,669,081 | 6/1972 | Monpetit | 123/179 G |
| 3,693,603 | 9/1972 | Lemanczyk | 123/179 G |
| 3,822,677 | 7/1974 | Reddy | 123/139 E |
| 3,867,918 | 2/1975 | Williams et al. | 123/32 EA |
| 3,886,921 | 6/1975 | Hafner | 123/139 E |
| 3,889,648 | 6/1975 | Williams et al. | 123/32 EA |
| 3,994,272 | 11/1976 | Brinkman | 123/139 E |

FOREIGN PATENT DOCUMENTS

| | | | |
|---|---|---|---|
| 1,228,832 | 9/1960 | France | 123/139 E |
| 568,216 | 3/1945 | United Kingdom | 123/139 E |
| 1,414,172 | 11/1975 | United Kingdom | 123/139 AN |

*Primary Examiner*—Charles J. Myhre
*Assistant Examiner*—R. A. Nelli
*Attorney, Agent, or Firm*—Ernest D. Buff

[57] ABSTRACT

A control system for a positive displacement, electrically actuated fuel pump receives one trigger pulse per engine cycle during normal operating conditions and a plurality of pulses per cycle during starting conditions from a computer circuit forming part of a fuel injection system. A control circuit generates one driving pulse for the fuel pump for each trigger pulse as long as the period between the pulses remains sufficient for the pump to complete its cycle and deletes control pulses to the pump when the engine speed is excessively high. A variable displacement electric pump is controlled to provide the engine with a fuel flow proportional to its operating rate by a variable on-time switching system controlled by an engine speed sensor and/or load sensor.

17 Claims, 4 Drawing Figures

Fig-1
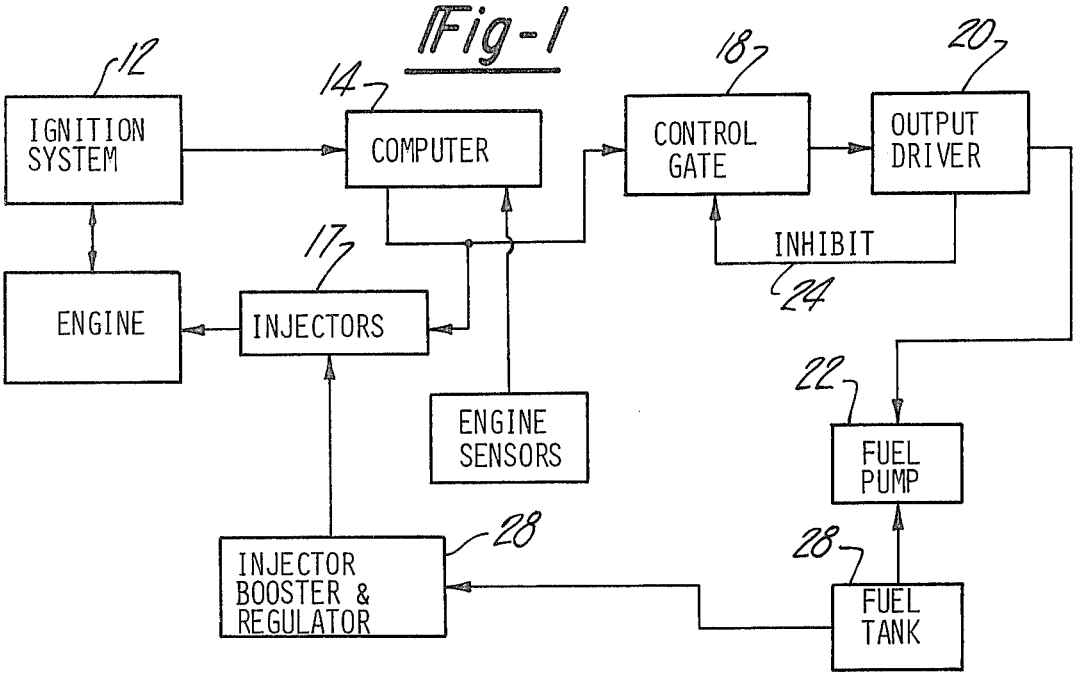
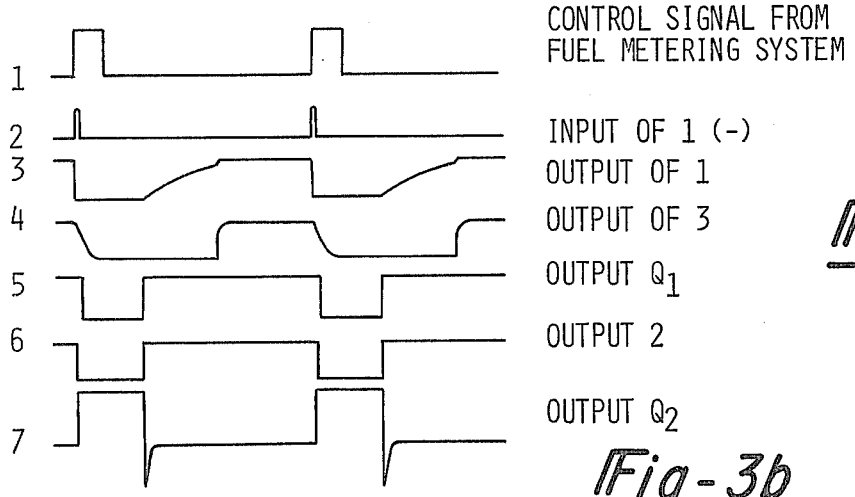
Fig-3a
Fig-3b
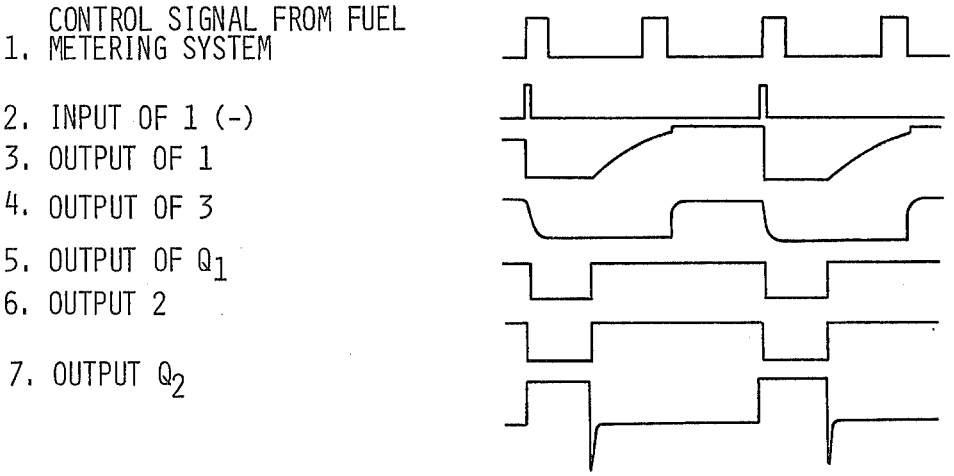

CONTROL SYSTEM FOR ELECTRICALLY ENERGIZED ENGINE FUEL

BACKGROUND OF THE INVENTION

1. Field of the Invention

This invention relates to systems for controlling electric fuel pumps for internal combustion engines and more particularly to fuel pump electronic control systems for use with fuel metering and injection systems. The invention may be used with a pump of the type described in my U.S. patent application, Ser. No. 629,421, entitled "Fuel Injection System" and in my U.S. patent application, Ser. No. 629,462, entitled "Electromagnetic Pump System," both filed concurrently herewith.

2. Prior Art

Electrically actuated fuel pumps provide a number of advantages over mechanically actuated pumps driven by the engine, and these electric pumps have been widely employed with engine carburetion systems and almost universally employed on engines having electronic fuel injection systems. Prior motor driven electric fuel pumps typically operate at a rate which may be independent of engine speed and have usually been powered at a rate controlled load criteria. However, in a typical automobile, such loads and speeds occur over relatively short intervals of time. Most of the time, the automobile has substantially lower fuel requirements, associated with lower speed and engine load. Since the prior set pumps are operating at all times for high fuel requirements, there is a waste of energy consumed by the pump and a waste of pump capacity. That part of the pump output which exceeds the instantaneous fuel demands of the engine is usually returned to the fuel tank through some form of overflow arrangement. This form of regulation results in unnecessary pump work, since the pumping rate is necessarily maintained substantially above the flow requirements, at most engine operating conditions, because of the relationship between pump load and engine fuel requirements.

This prior art method of controlling electric pumps does not represent the most efficient mode of operation because of the disparity between the pumping rate and the engine's fuel requirements. For one thing, the inherent pump noise is unnecessarily high and is particularly noticeable at idle and low engine speeds, when large flow volumes are not required. The relatively high pumping speed also shortens the pump life and is wasteful of battery power. Finally, the excessive flow rates result in a constant recirculation of the overflow fuel through the system, causing churning of fuel, which may be deleterious to its ignition properties.

SUMMARY OF THE INVENTION

The present invention is directed toward an electric fuel pumping system, such as motor driven system or other types of system, for an internal combustion engine which is activated to operate at a controlled rate, which is a function of the engine operating conditions, such as engine load and/or engine speed, to eliminate the problems of the prior art. The inventive system includes means connected to the engine for sensing the engine speed and/or engine load and control circuitry for receiving the speed signal and for generating an actvating signal that actuates the pump. Broadly, the pump is controlled to provide a flow that is in direct relation to the engine speed and/or engine load, thus its fuel consumption. Thus, at idle and low engine speeds the pump is operated at a low rate, minimizing power consumption by the pump, pump noise, wear of the pump, and fuel churning.

In a preferred embodiment of the invention, which will subsequently be disclosed in detail, the control signal to the pump takes one of three forms, depending upon engine condition. During engine start-up, the control system provides a signal to drive the pump at a higher than normal rate to insure that the fuel lines in the system are filled. After the engine starts, the pump is controlled to provide a flow proportional to engine speed, and/or load until a maximum pump speed is reached. The pump speed is maintained constant for engine speed increases above this point, preventing overloading of the pump.

The pump control system of the preferred embodiment is associated with the electronics of a fuel injection system. The preferred embodiment employs a piston pump. Constant width control pulses for activating the piston of the pump are triggered by signals derived from the fuel injection control. The fuel injection control provides one pulse per engine cycle during normal operating conditions and a plurality of pulses per cycle during starting. Each of these pulses trigger a single pump energizing pulse as long as the interval between the triggering pulses exceeds a predetermined limit. Intermittent trigger pulses are ignored at higher engine speeds to limit the pump speed to its maximum efficient rate.

Other objectives, advantages, and applications of the present invention will be made apparent by the following detailed description of the two embodiments of the invention. The description makes reference to the accompanying drawings in which:

FIG. 1 is a block diagram of a first embodiment of the invention which forms part of a fuel injection system and which drives the positive displacement system pump;

FIG. 3A is a plot of wave forms occurring at particular points within the system of FIGS. 1 and 2 during the cycle of engine operation, after starting, and below the critical speed; and FIG. 3B is a plot of similar wave forms with the engine operating above the critical speed.

Figure 2:
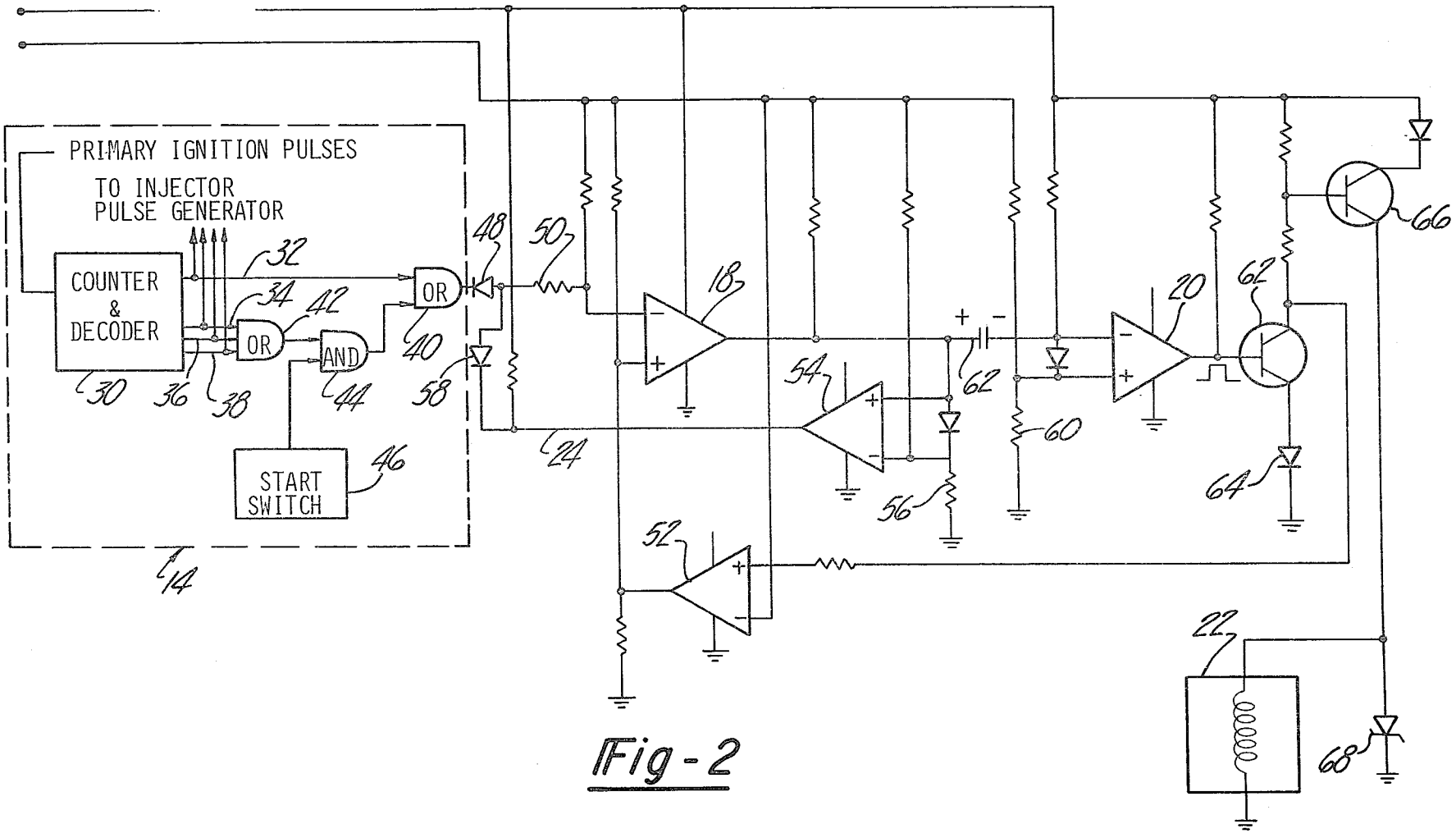
FIG. 2 is a detailed schematic diagram of the motor control circuitry of the embodiment of FIG. 1.

Referring to FIG. 1, the preferred embodiment of the present invention forms part of a fuel injection system for an internal combustion engine 10. The engine is equipped with an ignition system 12, which may be of either the conventional or electronic variety. The ignition system includes an element, such as a distributor, driven by the rotation of the engine, and the ignition provides the engine with firing pulses in timed relation to the Certain signals from the ignition system 12 are also provided to a computer 14. The computer also receives signals from a group of engine sensors 16 which provide electric signals having characteristics which vary as a function of engine parameters, such as manifold pressure, engine temperature and the like. The computer acts to provide variable width control pulses to fuel injectors 17 which feed the engine, with the width of the pulses, and their rate of occurrence, being functions of its input signals. A typical fuel injection computer is disclosed in my application Ser. No. 629,350, entitled "Start-Up Control for Fuel Injection System", filed concurrently herewith. That system provides each injector with one control pulse per cycle during normal engine operation and a plurality of pulses per cycle during starting of the engine.

These output pulses from the computer 14 are also provided to a control gate 18. The control gate in turn provides pulses to an output driver 20. The output driver supplies actuation electric pulses to the solenoid of a fuel pump 22.

During normal operation of the system the control gate 18 provides one output pulse to the driver 20 for each input pulse that it receives from the computer, and the driver provides one activating pulse to the fuel pump 22. However, when the frequency of the input pulses from the computer exceed a predetermined level, a signal provided from the output driver 20 to the control gate 18 via inhibit line 24, inhibits provision of the next pulse to the output driver. The inhibit signal occurs for a predetermined period of time after the output driver has terminated the pulse to the pump. Any pulses to the control gate from the computer which occur during that period are not effective to cause the generation of an output pulse.

The fuel pump 22 acts to pump fuel from a tank 26 to an injector booster and regulator 28. This unit provides a regulated, pressurized fuel supply for the injector valves 17.

The circuitry of the control gate 18, output driver 20, and the relevant portions of the computer 14, are illustrated schematically in FIG. 2. The computer 14 receives pulses from the primary of the ignition circuit which occur a plurality of times per engine cycle, in timed relation to the engine operation. For an eight cylinder four stroke engine, the computer will receive eight ignition pulses per engine cycle. These pulses are provided to a counter and decoder 30 which provides outputs on a plurality of lines 32, 34, 36 and 38, sequentially during an engine cycle. These pulses are provided to a plurality of injector pulse generators, which generate energizing pulses for each of the injectors or for each group of injectors where the injectors are grouped together.

The output on line 32 is provided directly to an OR gate 40. The outputs on lines 34, 36 and 38 are provided to a second OR gate 42. The output of the OR gate 42 is provided to an AND gate 44. The conditioning input on the AND gate 44 is provided from the engine start switch 46 which also controls the engine starter mechanism. When the starting switch 46 is energized, the pulses provided to the AND gate 44 from the OR gate 42 are fed to the OR gate 40, and summed with the pulses provided to that OR gate 40 on line 32. During normal operation of the engine, the start switch 46 will be open and the OR gate 40 will simply provide as its output the one pulse per engine cycle which occurs on line 32. During the starting conditions, when the start switch 46 is closed, the OR gate 40 will effectively provide the outputs of all four of the lines 32, 34, 36 and 38, in sequential relation, during an engine operating cycle.

The output pulses from the OR gate 40 are fed through a diode 48 and a resistor 50 to the negative input of the control gate 18, which is a differential amplifier.

The other input to the control gate 18 is provided from another differential amplifier 52. At the beginning of the circuit operation, the output of the differential amplifier 52 is high and the output of the differential amplifier 18 is low. When a positive pulse is generated by the computer 14, the output of the differential amplifier 18 goes high. This pulse is provided to the positive input of a third differential amplifier 54 which has a fixed voltage in its other input, controlled by resistance 56. The output of the differential amplifier 54 is normally high, and goes low as soon as it receives the positive pulse from the differential amplifier 18. This negative pulse is fed back to the negative input of the differential amplifier 18 through a diode 58 connected to the junction between diode 48 and resistance 50. Therefore, the signal at the negative input of the differential amplifier 18 goes low a few milliseconds after the beginning of a positive control pulse is received from the computer 14, despite continuation of the control pulse. The period for which the input is high is simply a function of the feed back delay through the differential amplifier 54 and its associated circuitry.

When the output of differential amplifier 18 goes high upon receipt of an input pulse from the computer 14, the high output is provided to the negative terminal of a fourth differential amplifier 20. The other input to the differential amplifier 20 is the voltage across a resistance 60. This pulse from the output of the differential amplifier 18 to the negative input of the differential amplifier 20 is fed through a capacitor 63.

The output of the differential amplifier 20 is fed to an amplifying transistor 62 which has its emitter grounded through a diode 64. The collector of transistor 62 is connected to the base of a second transistor 66. The pump solenoid 22 is connected in the collector circuit of transistor 66 and is shunted by a protective Zener diode 68. Accordingly, when the output of differential amplifier 20 goes high, that signal is amplified by the transistor 62, which drives the transistor 62 into saturated conduction. The output signal from transistor 62 is further amplified by transistor 66 which provides an actuation signal to the pump solenoid 22.

The signal from the collector of transistor 62 is also fed back to the positive input of differential amplifier 52, which has its output connected to the positive terminal of differential amplifier 18. The output of differential 52 goes low upon occurrence of the output pulse to the pump solenoid and prevents the output of gate 18 from going high even after its negative input goes low because of the action of differential amplifier 54.

After the output of differential amplifier 18 goes low, the capacitor 63 begins to change through the resistance 56, providing an increasingly positive voltage to the negative input of the differential amplifier 20. When the voltage at the negative input reaches the level of the positive input, the output of differential amplifier 20 goes low. This acts through the transistors 62 and 66 to terminate the pulse to the pump solenoid 22. It also causes the output of differential amplifier 52 to go high again. Thus, the length of the output pulse to the pump solenoid is controlled by the time delay provided by the capacitor 63 and the resistance 56.

Once the output of differential amplifier 52 has returned to high, the differential amplifier 18 could return to a high output, except that the voltage at the output is limited by the charge on the capacitor 63. This acts through differential amplifier 54 to retain the voltage at resistance 50, and the input of the differential amplifier 18 is low. Capacitor 63 now charges in a reverse direction, through the resistance 60. When a sufficient charge has built up in that direction, the differential amplifier 54 switches its output, and returns to its condition at the beginning of the cycle. Input pulses from the computer 14, received after this time, will trigger output pulses to the pump 22. Any signals from the computer 14 received before this time will be inhibited by the negative output of differential amplifier 54.

Thus, the time constant determined by the values of the capacitor 63 and the resistance 60, sets a minimum time interval between output pulses to the pump. This minimum is to insure adequate time for the pump to displace its fuel output after having been activated by the previous pulse. If the pump were pulsed at a higher frequency, its fuel output would deteriorate.

The operation of the circuitry of FIG. 2 is illustrated by the wave forms of FIG. 3. The seven wave forms of FIG. 3A illustrate the operation of the system after starting, up to the critical speed. The seven wave forms of FIG. 3B illustrate the operation of the system in the normal mode, above the critical speed.

FIG. 3A-1 is a plot of trigger signals provided from the computer 14 to the diode 48.

FIG. 3A-2 is a plot of the resulting input to the negative terminal of the differential amplifier 18. The input goes high at the instant a positive going control signal is received from the computer 14 and then goes low a fraction of a second later as a result of feed-back through differential amplifier 54.

FIG. 3A-3 plots the output of differential amplifier 18 during a cycle. The output goes low when the control pulse is received at its negative input and stays low until the output of differential amplifier 20 terminates as a result of charging of the capacitor 63. The voltage at the output of differential amplifier 18 then gradually builds up as capacitor 63 charges in the opposite direction.

FIG. 3A-4 plots the output of differential amplifier 54. It goes low slightly after the control pulse is received and stays low until the capacitor 63 has discharged the charge that it receives while the output of the differential amplifier 18 is low.

FIG. 3A-5 is a plot of the output of transistor 62. It goes low slightly after receipt of the control pulse and then goes high after the charge on capacitor 63 has built up sufficiently to turn off the differential amplifier 20.

FIG. 3A-6 is a plot of the output of differential amplifier 52 which substantially follows the output of transistor 62.

FIG. 3A-7 is a plot of the output of transistor 66 during the cycle. It should be noted that there is one output pulse for each control input of line 1 and the output lasts for a period of time determined by the time constant of the capacitor 63 and resistance 60.

FIG. 3B illustrates the comparable wave forms when the frequency of the control pulses increases to the point where the interval between the pulses is less than the time required for the capacitor 63 to charge and then discharge. The second fourth control pulses in the train illustrated in FIG. 3B-1 are terminated before the output of differential amplifier 54 regains its high level and accordingly they do not trigger the generation of control pulses to the pump solenoid.

In on another embodiment using a pump driven by an electric motor, instead of a piston pump, the pulse output of transistor 66 in FIG. 2 could be averaged through additional circuit imponents to provide a D.C. voltage whose value would be proportioned to engine speed criteria to operate the pump motor. In an embodiment used with a fuel injection system, the duration of the injector signal which is proportional to engine load varies directly as a function of engine load and may be used as an additional pump control parameter.

The embodiments of the invention in which an exclusive property or privilege is claimed are defined as follows:

1. A control system for a fuel pump for a spark ignited, internal combustion engine having a fuel injection system, said fuel pump being a solenoid actuated, positive variable displacement piston pump; said control system comprising: means connected to the engine for generating an electric signal which varies as engine speed; and means controlled by said electric signal for generating one trigger pulse per engine cycle to said pump for energizing the solenoid of the pump to reset the piston once per engine cycle to provide a fuel flow at a rate which is a function of said signal, said means for generating one trigger pulse comprising counter means for generating said pulse, gate means for permitting delivery of said pulse to said solenoid once per engine cycle and pulse forming means for changing the duration of said pulse.

2. The control system of claim 1 and further comprising: means for increasing the operating rate of the fuel pump during starting of the engine relative to its rate under non-starting conditions.

3. The control system of claim 1, wherein said internal combustion engine has a starter switch and said control system includes means responsive to actuation of said starter switch for generating a plurality of trigger pulses, and delivering said plurality of pulses sequentially to said pump once per engine cycle for energizing the solenoid of said pump to reset the piston a plurality of times per engine cycle during starting.

4. The control system of claim 1 wherein the pulses have a frequency directly proportional to engine speed.

5. The system of claim 4 wherein the means for energizing the pump under control of said electric signal comprises a pulse generator.

6. The system of claim 1 wherein said means for controlling the rate of operation of the fuel pump comprises an electric power supply operative to supply the pump with actuating pulses proportional to said electric signal.

7. The system of claim 6 and further comprising means for deleting said actuating pulses to said pump when engine speed exceeds a predetermined value.

8. A control system for a fuel pump for a spark ignited, internal combustion engine having a fuel injection system, said fuel pump being a solenoid actuated, positive variable displacement piston pump; said control system comprising: means connected to the engine for generating an electric signal which varies as engine load; and means controlled by said electric signal for generating one trigger pulse per engine cycle to said pump for energizing the solenoid of the pump to reset the piston once per engine cycle to provide a fuel flow at a rate which is a function of said signal, said means for generating one trigger pulse comprising counter means for generating said pulse, gate means for permitting delivery of said pulse to said solenoid once per engine cycle and pulse forming means for changing the duration of said pulse.

9. The control system of claim 8 wherein the fuel pump is of the positive, variable displacement type and said means for controlling the rate of operation of the fuel pump comprises an electric power supply operative to supply the pump with a current proportional to said signal.

10. The control system of claim 8 including means for increasing the operating rate of the fuel pump during starting of the engine relative to its rate under non-starting conditions.

11. The control system of claim 8 wherein said pulses have a frequency directly proportional to engine speed.

12. The control system of claim 11 wherein the fuel pump is of the positive, variable displacement type and the means for energizing the pump under control of said electric signal comprises a pulse generator.

13. A control system for a fuel pump for a spark ignited, internal combustion engine having a fuel injection system, said fuel pump being a solenoid actuated, positive variable displacement piston pump; said control system comprising: means connected to the engine for generating an electric signal which varies as engine speed; and means controlled by said electric signal for generating one trigger pulse per engine cycle to said pump for energizing the solenoid of the pump to reset the piston once per engine cycle to provide a fuel flow at a rate which is a function of said signal, said means for generating one trigger pulse comprising counter means for generating said pulse, gate means for permitting delivery of said pulse to said solenoid once per engine cycle and pulse forming means for changing the duration of said pulse, said means for controlling the rate of operation of the fuel pump comprising an electric power supply operative to supply the pump with actuating pulses proportional to said electric signal, and said control system further comprising means for deleting said actuating pulses to said pump when engine speed exceeds a predetermined value.

14. The system of claim 13, wherein said means for generating one trigger pulse per engine cycle includes counter means for generating said pulse, gate means for permitting delivery of said pulse to said solenoid once per engine cycle and pulse forming means for changing the duration of said pulse.

15. The system of claim 13 wherein said means for controlling the rate of operation of the fuel pump comprises an electric power supply operative to supply the pump with actuating pulses proportional to said electric signal.

16. The control system of claim 13 wherein the pulses have a frequency directly proportional to engine speed.

17. The system of claim 16 whrein the means for energizing the pump under control of said electric signal comprises a pulse generator.

* * * * *